US006921874B2

(12) United States Patent
Tseng

(10) Patent No.: US 6,921,874 B2
(45) Date of Patent: Jul. 26, 2005

(54) ROTATIONAL SPEED SWITCHING APPARATUS OF A CEILING FAN

(76) Inventor: Ming-Chi Tseng, No. 18, Jhensing E. St., Wufong Township, Taichung City (TW)

( * ) Notice: Subject to any disclaimer, the term of this patent is extended or adjusted under 35 U.S.C. 154(b) by 166 days.

(21) Appl. No.: 10/626,657

(22) Filed: Jul. 25, 2003

(65) Prior Publication Data

US 2005/0016827 A1 Jan. 27, 2005

(51) Int. Cl.[7] ..... H01H 17/18
(52) U.S. Cl. ..... 200/544; 200/543
(58) Field of Search ..... 200/537, 543–546, 200/51.15, 11 A, 413, 420, 331; 318/778, 779, 794

(56) References Cited

U.S. PATENT DOCUMENTS 2,318,057 A * 5/1943 Cohen ..... 315/96
4,766,277 A * 8/1988 Bigelow, Jr. ..... 200/293
5,252,794 A * 10/1993 Tseng ..... 200/51.15
5,278,366 A * 1/1994 Fleischhauer ..... 200/51.15
5,300,871 A * 4/1994 Bucher et al. ..... 318/794

* cited by examiner

*Primary Examiner*—Michael A. Friedhofer
(74) *Attorney, Agent, or Firm*—Rosenberg, Klein & Lee

(57) ABSTRACT

A rotational speed switching apparatus includes a seat body in which a rotary shaft is pivotally disposed and a pull rotary assembly for driving the rotary shaft to one-way circularly rotate. Each time the rotary shaft rotates, the rotary shaft rotates by 72 degrees. A stepped conductive ring is fitted around the rotary shaft and has an upper, a middle, a lower and a connecting section extending from the lower section to a bottom of the rotary shaft. The widths of the upper, middle and lower sections are respectively 72 degrees of the circumference of the conductive ring. The interior of the seat body is partitioned into five receptacles at equal intervals. The four contacts cooperate with two capacitors to achieve five-stage switch of the rotational speed.

4 Claims, 7 Drawing Sheets

ROTATIONAL SPEED SWITCHING APPARATUS OF A CEILING FAN

BACKGROUND OF THE INVENTION

The present invention is related to a rotational speed switching apparatus of a ceiling fan. The switching apparatus has four contacts cooperating with only two voltage-dropping capacitors to achieve five-stage switch of the rotational speed.

FIG. 9 shows a conventional rotational speed switch of a ceiling fan. The rotational speed switch includes a pull rotary assembly 81 for driving a rotary shaft 83 disposed in a seat body 82 to one-way circularly rotate. A stepped conductive ring 84 is fitted around the rotary shaft 83. The interior of the seat body 82 is partitioned into four receptacles 821, 822, 823, 824 in which conductive leaf springs 85, 86 and conductive members (not shown) are respectively disposed to form four contacts L, A, B, C. Accordingly, an operator can pull and rotate the pull rotary assembly 81 to control the rotational speed of the ceiling fan.

FIG. 10 is a circuit diagram of the conventional rotational-speed switch of the ceiling fan. When the contact L is not in contact with other contacts, the motor of the ceiling fan is turned off. When the contact L is electrically connected with the contact A, via an activating capacitor 871, an activating coil 881 is energized to activate the motor. After the motor operates, directly through the forward backward switch 89, a main coil 882 is energized to drive the motor to operate at high speed. When the contact L is electrically connected with the contact B, the current will pass through a first capacitor 872 with lower capacitance and the forward backward switch 89 to energize the main coil 882 to drive the motor to operate at middle speed. When the contact L is electrically connected with the contact C, the current will pass through a second capacitor 873 with higher capacitance and the forward backward switch 89 to energize the main coil 882 to drive the motor to operate at low speed. Accordingly, the rotational speed can be switched among four stages, that is, stop, fast, middle and slow stages.

However, the four-stage switch of rotational speed is insufficient at present time. It is now commercially required to have five-stage switch of rotational speed. In case the conventional rotational speed switch is expanded to five-stage switch, the circuit will be more complicated and the number of capacitors will be increased. This will increase the manufacturing cost and lower the competitive ability of the product.

SUMMARY OF THE INVENTION

It is therefore a primary object of the present invention to provide a rotational speed switching apparatus of a ceiling fan. A stepped conductive ring is fitted around the rotary shaft and has an upper, a middle and a lower section which continuously fall. The lower section has a connecting section extending from the lower section to a bottom of the rotary shaft. The widths of the upper, middle and lower sections are respectively 72 degrees of the circumference of the conductive ring. The interior of the seat body is partitioned into five receptacles at equal intervals. Different numbers of conductive members and conductive leaf springs are disposed in the four of the receptacles respectively corresponding to the upper, middle, lower and connecting sections of the conductive ring to form four contacts. The four contacts cooperate with two capacitors to achieve five-stage switch of the rotational speed.

According to the above object, the rotational speed switching apparatus of the ceiling fan includes a seat body and a pull rotary assembly.

A conductive ring is fitted around the rotary shaft. The conductive ring is stepped and has an upper section, a middle section and a lower section that continuously fall. The widths of the upper, middle and lower sections are respectively 72 degrees of the circumference of the conductive ring. The lower section has a connecting section extending from the lower section to a bottom of the rotary shaft. The interior of the seat body is partitioned into a first receptacle, a second receptacle, a third receptacle, a fourth receptacle and a fifth receptacle at equal intervals. A ring-shaped conductive member is disposed in the first receptacle corresponding to the connecting section of the conductive ring to form a first contact. Two conductive leaf springs are disposed in the second receptacle respectively corresponding to the upper and lower sections of the conductive ring to form a second contact. Two conductive leaf springs are disposed in the third receptacle respectively corresponding to the upper and middle sections of the conductive ring to form a third contact. A conductive leaf spring is disposed in the fifth receptacle corresponding to the upper section of the conductive ring to form a fifth contact.

The pull rotary assembly serves to drive the rotary shaft in the seat body to one-way circularly rotate. Each time the rotary shaft rotates, the rotary shaft rotates by 72 degrees.

The present invention can be best understood through the following description and accompanying drawings wherein:

DETAILED DESCRIPTION OF THE PREFERRED EMBODIMENT

Figure 1:
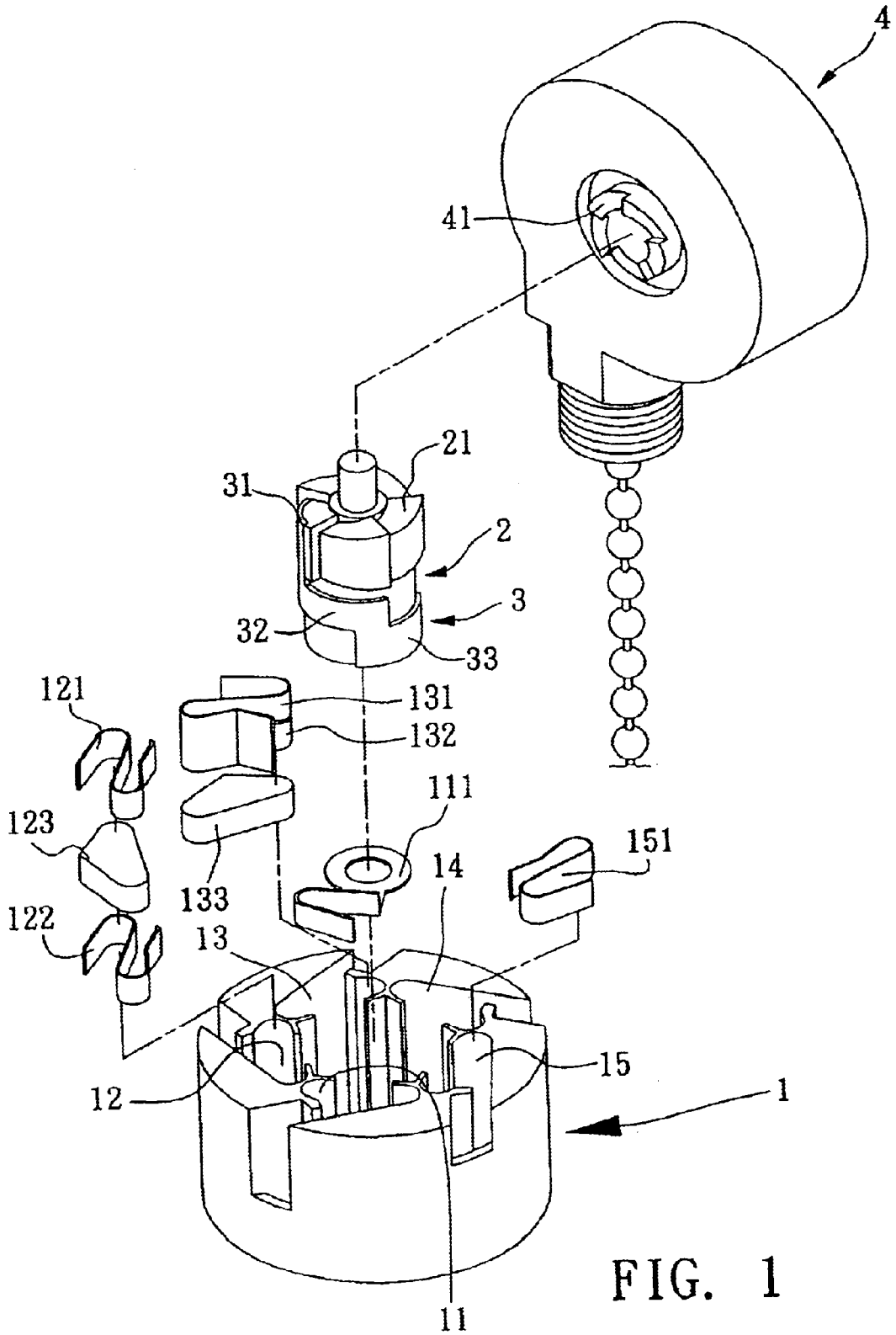
FIG. 1 is a perspective exploded view of the present invention.
Figure 2:
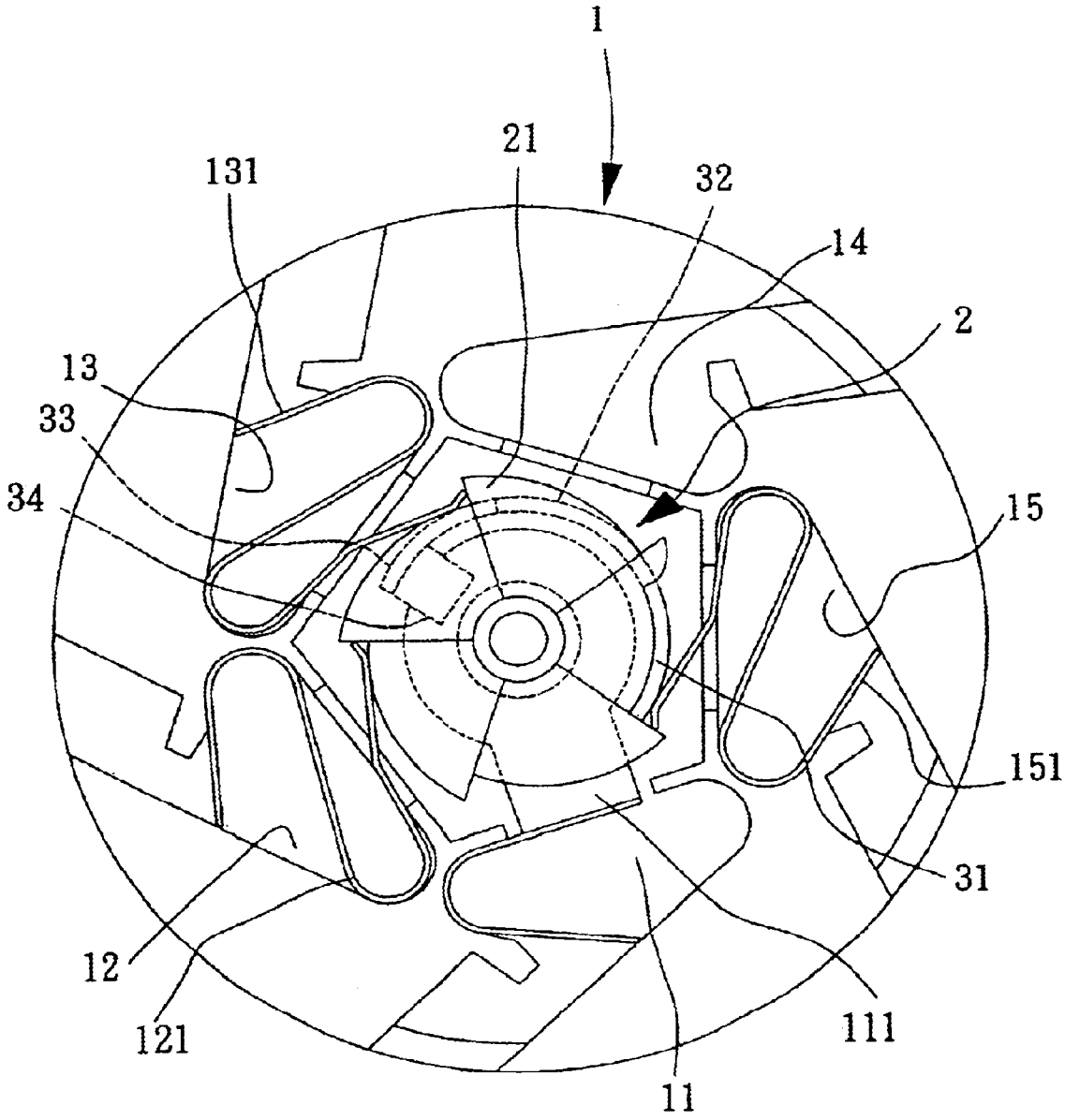
FIG. 2 is a top view of the seat body of the present invention.

Please refer to FIGS. 1 to 8. The rotational speed switching apparatus of the ceiling fan of the present invention includes a seat body 1 and a pull rotary assembly 4.

A rotary shaft 2 is pivotally disposed in the seat body 1. A conductive ring 3 is fitted around the rotary shaft 2. The conductive ring 3 is stepped to have an upper section 31, a middle section 32 and a lower section 33 which continuously fall. The widths of the upper, middle and lower sections 31, 32, 33 are respectively 72 degrees of the circumference of the conductive ring 3. The lower section 33 has a connecting section 34 extending from the lower section 33 to the bottom of the rotary shaft 2.

The interior of the seat body 1 is partitioned into a first receptacle 11, a second receptacle 12, a third receptacle 13, a fourth receptacle 14 and a fifth receptacle 15 at equal intervals.

A ring-shaped conductive member 111 is disposed in the first receptacle 11 corresponding to the connecting section 34 of the conductive ring 3 to form a first contact L.

Two conductive leaf springs 121, 122 are disposed in the second receptacle 12 respectively corresponding to the upper and lower sections 31, 33 of the conductive ring 3 to form a second contact A. An insulating block 123 is disposed between the two conductive leaf springs 121, 122.

Two conductive leaf springs 131, 132 are disposed in the third receptacle 13 respectively corresponding to the upper and middle sections 31, 32 of the conductive ring 3 to form a third contact B. In this embodiment, the two conductive leaf springs 131, 132 are made by integral punch. An insulating block 133 is disposed in the third receptacle 13 corresponding to the lower section 33 of the conductive ring 3.

No conductive member or conductive leaf spring is disposed in the fourth receptacle 14 to form a fourth contact C.

A conductive leaf spring 151 is disposed in the fifth receptacle 15 corresponding to the upper section 31 of the conductive ring 3 to form a fifth contact D.

The pull rotary assembly 4 includes a ratchet ring 41. The rotary shaft 2 has a ratchet section 21 corresponding to the ratchet ring 41. Accordingly, the pull rotary assembly 4 can drive the rotary shaft 2 to one-way circularly rotate. Each time the rotary shaft 2 rotates, the rotary shaft 2 rotates by 72 degrees.

Figure 3:
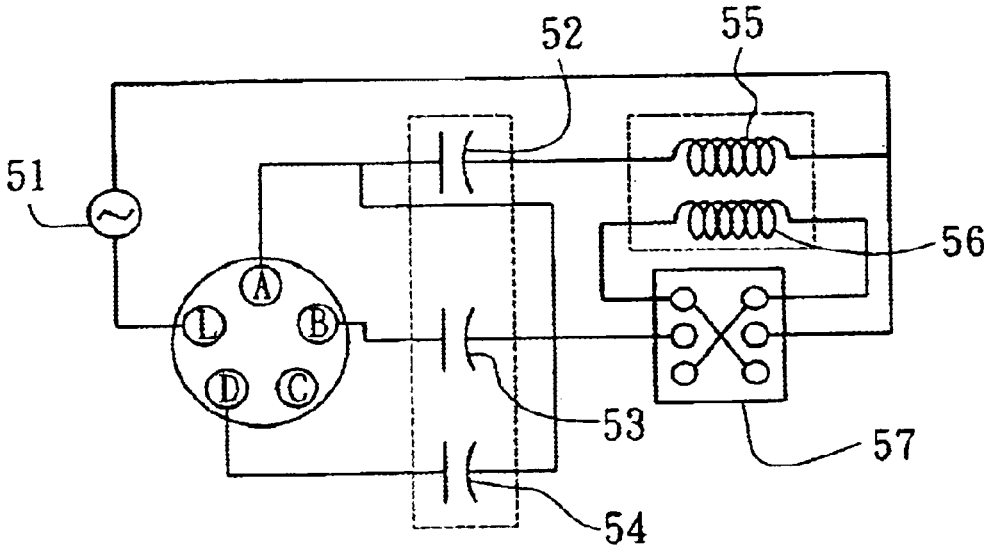
FIG. 3 is a circuit diagram of the capacitance voltage dropping circuit cooperating with the rotational speed switching apparatus of the present invention.

FIG. 3 is a circuit diagram of the capacitance voltage dropping circuit cooperating with the rotational speed switching apparatus of the ceiling fan of the present invention. One terminal of the A.C. power supply 51 is connected with the first contact L. Via an activating capacitor 52, the second contact A is connected to an activating coil 55. The second contact A is also directly connected with a forward backward switch 57 and connected to a main coil 56. The third contact B via a first capacitor 53 with lower capacitance is connected with the forward backward switch 57 and connected to the main coil 56. The fourth contact C is an idle contact. The fifth contact D via a second capacitor 54 with higher capacitance is connected with the forward backward switch 57 and connected to the main coil 56. The other terminal of the A.C. power supply 51 is connected with the activating coil 55 and the forward backward switch 57.

Figure 4:
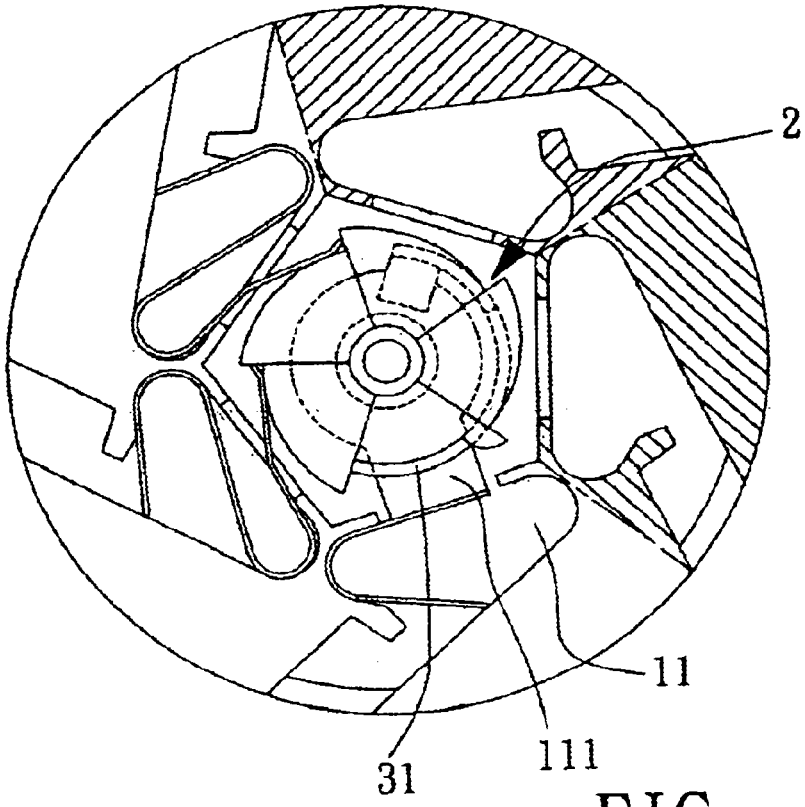
FIG. 4 shows the use of the present invention in a first state.

Please now refer to FIGS. 4 to 8 as well as FIG. 3 which illustrate the five-stage switch of the present invention. As shown in FIG. 4, when the upper section 31 of the conductive ring 3 is aligned with the first receptacle 11, the conductive ring 3 only contacts with the conductive member 111 in the first receptacle 11. That is, the first contact L is not electrically connected with any other contact. At this time, the capacitance voltage dropping circuit is in an off state.

Figure 5:
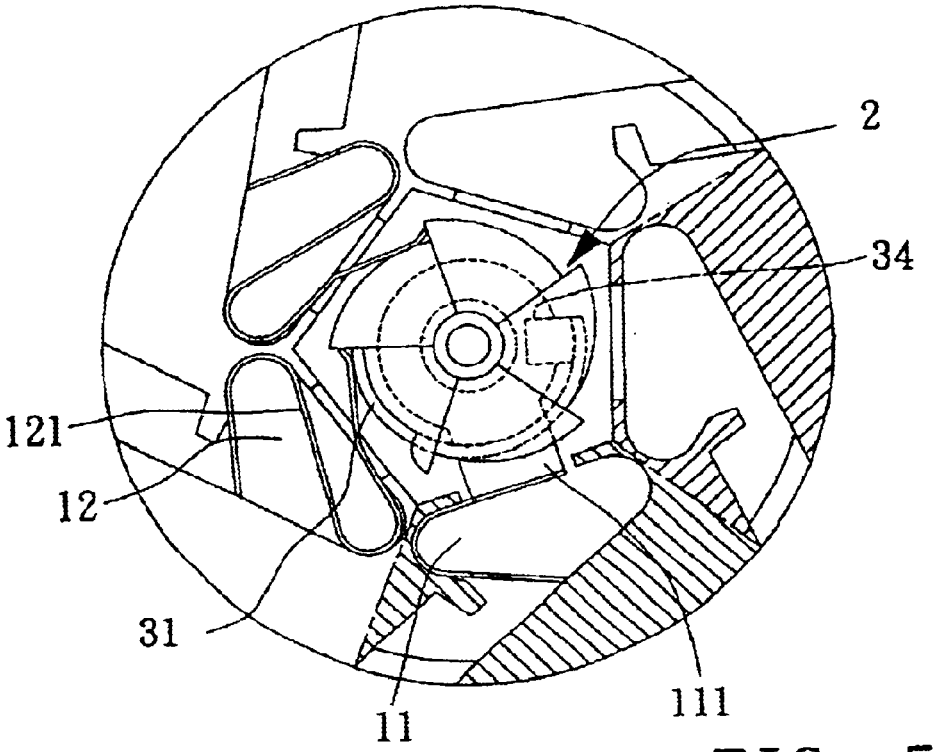
FIG. 5 shows the use of the present invention in a second state.

When an operator pulls the pull rotary assembly 4 to drive the rotary shaft 2 to rotate by 72 degrees and make the upper section 31 of the conductive ring 3 aligned with the second receptacle 12, as shown in FIG. 5, the upper section 31 and the connecting section 34 of the conductive ring 3 respectively contact with the conductive leaf spring 121 of the second receptacle 12 and the conductive member 111 in the first receptacle 11, whereby the first contact L is electrically connected with the second contact A. At this time, the current will first via the activating capacitor 52 energizes the activating coil 55 to activate the motor of the ceiling fan. After the motor operates, the current directly passes through the forward backward switch 57 to energize the main coil 56 to drive the motor to operate at high speed.

Figure 6:
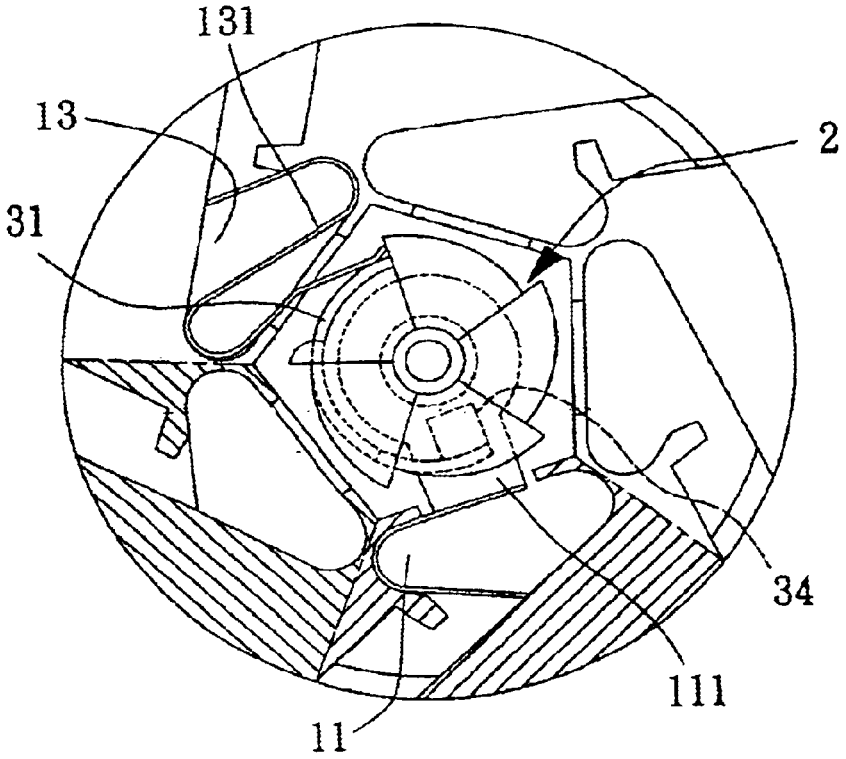
FIG. 6 shows the use of the present invention in a third state.

When the rotary shaft 2 is again rotated by 72 degrees to make the upper section 31 of the conductive ring 3 aligned with the third receptacle 13 as shown in FIG. 6, the upper section 31 and the connecting section 34 of the conductive ring 3 respectively contact with the conductive leaf spring 131 of the third receptacle 13 and the conductive member 111 in the first receptacle 11, whereby the first contact L is electrically connected with the third contact B. At this time, the current will via the first capacitor 53 pass through the forward backward switch 57 to energize the main coil 56 for driving the motor of the ceiling fan. The first capacitor 53 has lower capacitance to generate small voltage drop. Therefore, the motor will operate at sub-high speed.

Figure 7:
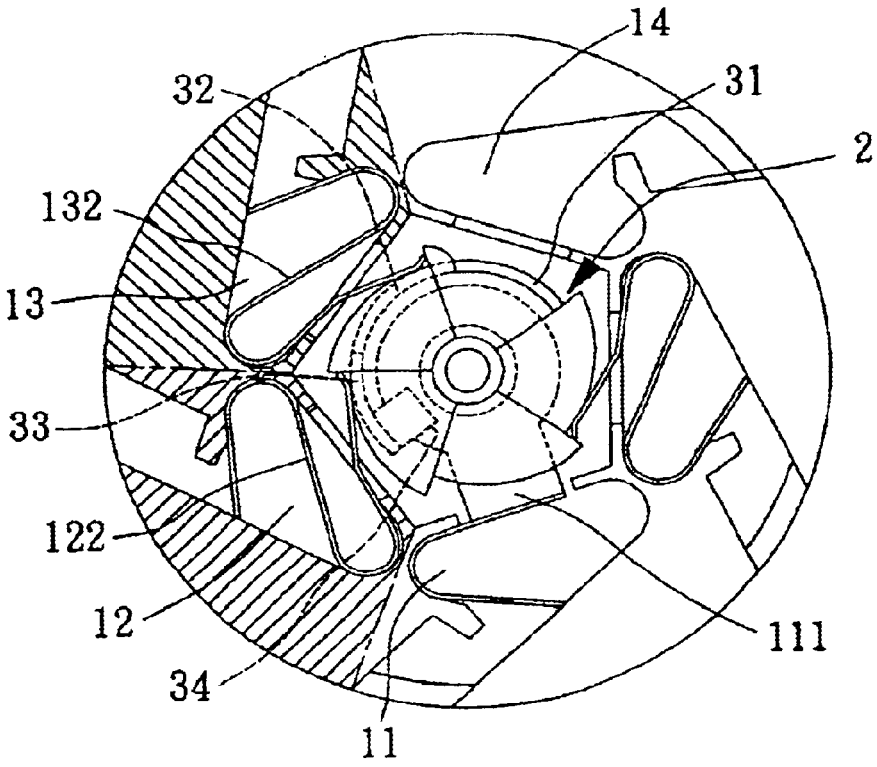
FIG. 7 shows the use of the present invention in a fourth state.

When the rotary shaft 2 is again rotated by 72 degrees to make the upper section 31 of the conductive ring 3 aligned with the fourth receptacle 14 as shown in FIG. 7, the middle section 32, lower section 33 and the connecting section 34 of the conductive ring 3 respectively contact with the conductive leaf spring 132 of the third receptacle 13, the conductive leaf spring 122 in the second receptacle 12 and the conductive member 111 in the first receptacle 11, whereby the first contact L is electrically connected with the second contact A and the third contact B to divide the current. After divided, a part of the current will via the first capacitor 53 pass through the forward backward switch 57 to energize the main coil 56 for driving the motor of the ceiling fan to operate at middle speed.

Figure 8:
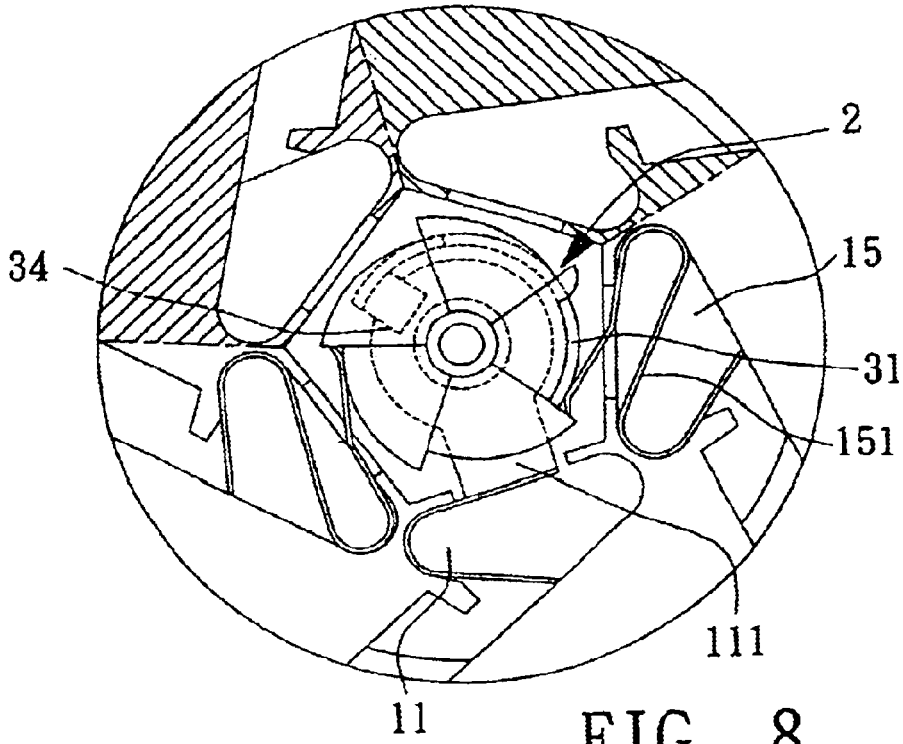
FIG. 8 shows the use of the present invention in a fifth state.
Figure 9:
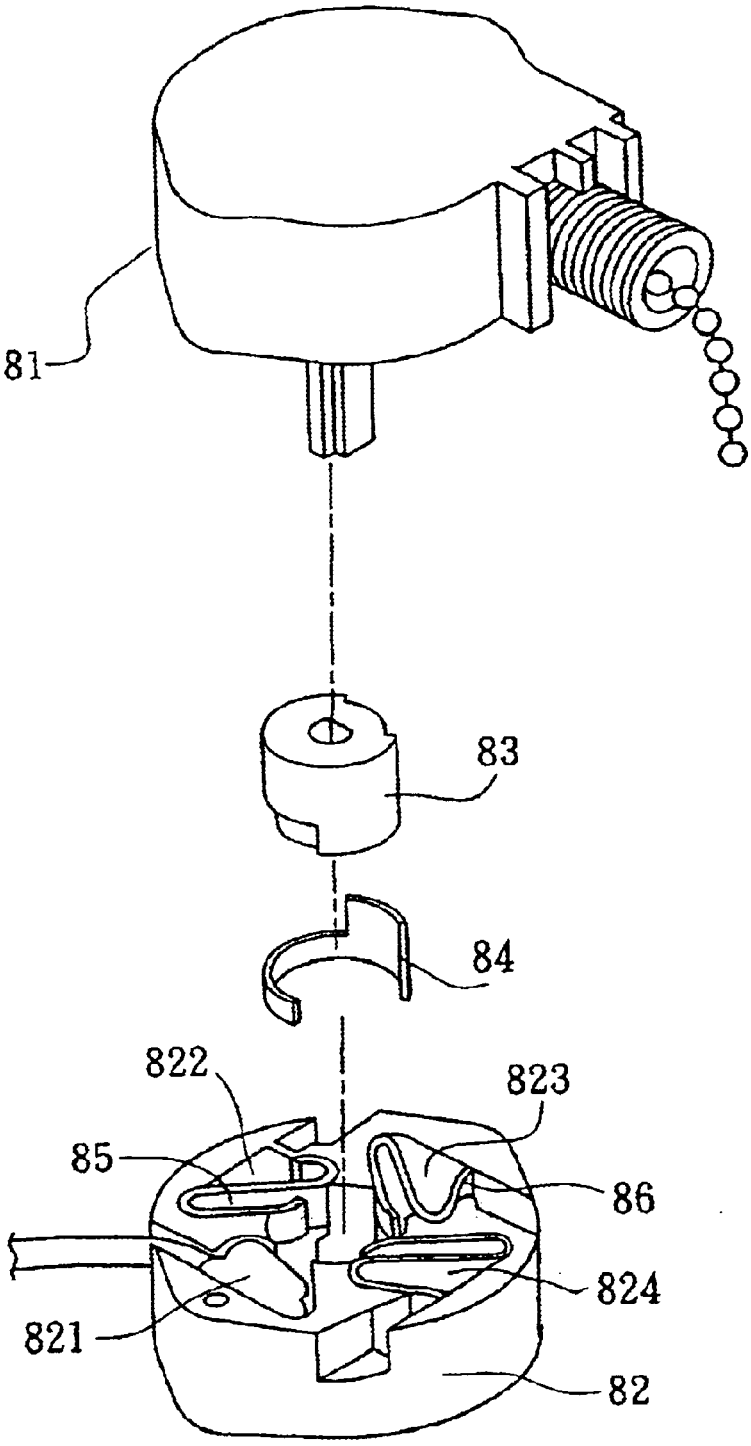
FIG. 9 PRIOR ART
FIG. 9 is a perspective exploded view of a conventional rotational speed switch of a ceiling fan.
Figure 10:
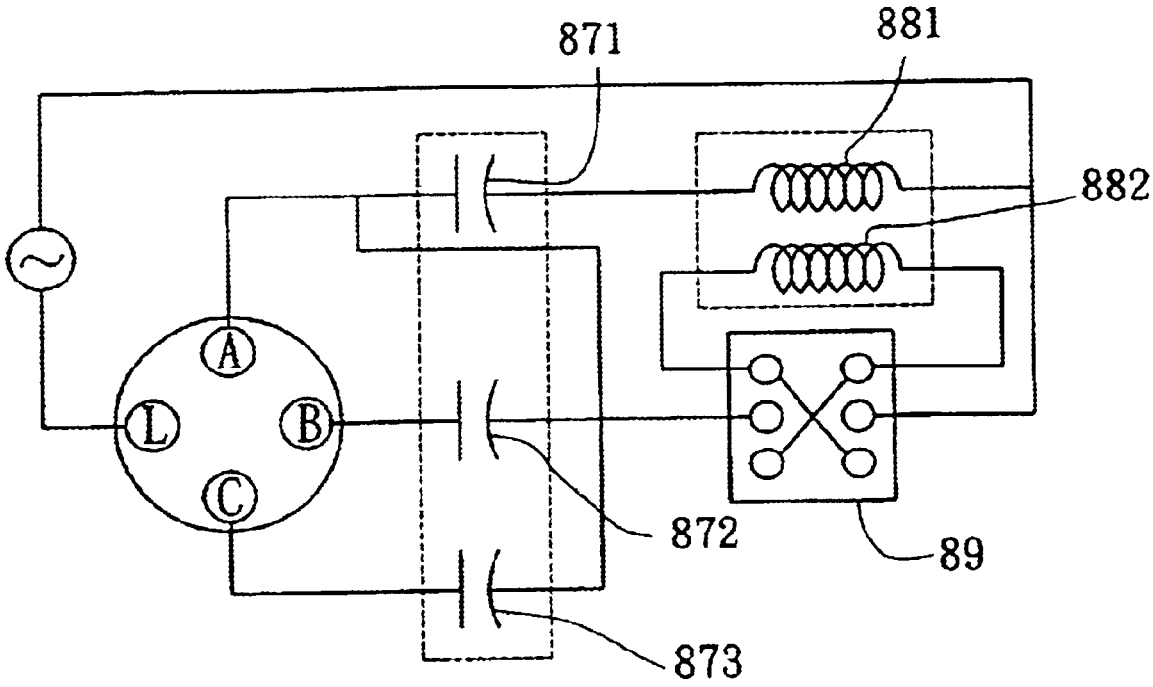
FIG. 10 PRIOR ART
FIG. 10 is a circuit diagram of the conventional rotational speed switch of the ceiling fan.

When the rotary shaft 2 is again rotated by 72 degrees to make the upper section 31 of the conductive ring 3 aligned with the fifth receptacle 15 as shown in FIG. 8, the upper section 31 and the connecting section 34 of the conductive ring 3 respectively contact with the conductive leaf spring 151 of the fifth receptacle 15 and the conductive member 111 in the first receptacle 11, whereby the first contact L is electrically connected with the fifth contact D. At this time, the current will via the second capacitor 54 pass through the forward backward switch 57 to energize the main coil 56 for driving the motor of the ceiling fan. The second capacitor 54 has higher capacitance to generate greater voltage drop. Therefore, the motor will operate at low speed.

When the operator again pulls the pull rotary assembly 4 to drive the rotary shaft 2 to rotate by 72 degrees, the upper section 31 of the conductive ring 3 is again aligned with the first receptacle 11. At this time, the capacitance voltage dropping circuit is restored to the off state. Accordingly, the rotational speed can be switched among five stages.

In conclusion, the conductive ring 3 is stepped to have an upper section 31, a middle section 32 and a lower section 33 which continuously fall. The lower section 33 has a connecting section 34 extending from the lower section 33 to the bottom of the rotary shaft 2. The widths of the upper, middle and lower sections 31, 32, 33 are respectively 72 degrees of the circumference of the conductive ring 3. The interior of the seat body 1 is partitioned into a first receptacle 11, a second receptacle 12, a third receptacle 13, a fourth receptacle 14 and a fifth receptacle. The conductive member 111 and the conductive leaf springs 121, 122, 131, 132, 151 are disposed in the first, second, third and fifth receptacles, 11, 12, 13, 15 respectively corresponding to the upper, middle, lower and connecting sections 31, 32, 33 and 34 of the conductive ring 3 to form a first, a second, a third and a fifth contact L, A, B, D. The four contacts cooperate with the first and second capacitors 53, 54 with different capacitances to achieve five-stage switch of the rotational speed.

The above embodiment is only used to illustrate the present invention, not intended to limit the scope thereof. Many modifications of the above embodiment can be made without departing from the spirit of the present invention.

What is claimed is:

1. A rotational speed switching apparatus of a ceiling fan, comprising:

a seat body in which a rotary shaft is pivotally disposed, a conductive ring being fitted around the rotary shaft, the conductive ring being stepped to have an upper section, a middle section and a lower section which continuously fall, the widths of the upper, middle and lower sections being respectively 72 degrees of the circumference of the conductive ring, the lower section having a connecting section extending from the lower section to a bottom of the rotary shaft, an interior of the seat body being partitioned into a first receptacle, a second receptacle, a third receptacle, a fourth receptacle and a fifth receptacle at equal intervals, a ring-shaped conductive member being disposed in the first receptacle corresponding to the connecting section of the conductive ring to form a first contact, two conductive leaf springs being disposed in the second receptacle respectively corresponding to the upper and lower sections of the conductive ring to form a second contact, two conductive leaf springs being disposed in the third receptacle respectively corresponding to the upper and middle sections of the conductive ring to form a third contact, a conductive leaf spring being disposed in the fifth receptacle corresponding to the upper section of the conductive ring to form a fifth contact; and a pull rotary assembly for driving the rotary shaft in the seat body to one-way circularly rotate, each time the rotary shaft rotates, the rotary shaft rotating by 72 degrees.

2. The rotational speed switching apparatus of the ceiling fan as claimed in claim 1, wherein an insulating block is disposed between the two conductive leaf springs in the second receptacle.

3. The rotational speed switching apparatus of the ceiling fan as claimed in claim 1, wherein an insulating block is disposed in the third receptacle corresponding to the lower section of the conductive ring.

4. The rotational speed switching apparatus of the ceiling fan as claimed in claim 1, wherein the pull rotary assembly includes a ratchet ring and the rotary shaft has a ratchet section corresponding to the ratchet ring, whereby the pull rotary assembly can drive the rotary shaft to one-way circularly rotate.

* * * * *